US006853117B2

(12) United States Patent
Toshima et al.

(10) Patent No.: US 6,853,117 B2
(45) Date of Patent: Feb. 8, 2005

(54) ELECTRON SOURCE AND PRODUCING METHOD THEREFOR

(75) Inventors: Hiroaki Toshima, Tokyo (JP); Kazuya Ishiwata, Kanagawa (JP); Yoshimi Uda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 10/207,842

(22) Filed: Jul. 31, 2002

(65) Prior Publication Data

US 2003/0030357 A1 Feb. 13, 2003

(30) Foreign Application Priority Data

Aug. 2, 2001 (JP) ..... 2001/234364

(51) Int. Cl.[7] ..... H01J 1/00
(52) U.S. Cl. ..... 313/304; 313/495; 313/310
(58) Field of Search ..... 313/293–304, 313/495–497, 631, 238, 310, 326

(56) References Cited

U.S. PATENT DOCUMENTS

| | | | | |
|---|---|---|---|---|
| 5,023,110 A | | 6/1991 | Nomura et al. | 427/49 |
| 5,585,689 A | * | 12/1996 | Imura et al. | 313/336 |
| 6,366,014 B1 | * | 4/2002 | Kuroda et al. | 313/495 |
| 6,459,207 B1 | * | 10/2002 | Nomura et al. | 315/169.3 |
| 6,522,054 B2 | * | 2/2003 | Shibata | 313/310 |
| 6,642,649 B1 | * | 11/2003 | Yamamoto et al. | 313/495 |

FOREIGN PATENT DOCUMENTS

| | | |
|---|---|---|
| JP | 2-56822 | 2/1990 |
| JP | 10-39788 | 2/1998 |

OTHER PUBLICATIONS

M.L. Elinson, et al., *The Emission of Hot Electrons and the Field Emission of Electrons from Tin Oxide*, Radio Engineering and Electronic Physics, Jul. 1965, pp. 1290–1296.
G. Dittmer, *Electrical Conduction and Electron Emission of Discontinuous Thin Films*, Thin Solid Films, 9 (1972) pp. 317–328.
M. Hartwell et al., *Strong Electron Emission From Patterned Tin–Indium Oxide Thin Films*, Int'l Electron Devices Meeting, (1975) pp. 519–521.
Araki, et al., *Electroforming and Electron Emission of Carbon Thin Films*, Electron Beam Laboratory, Faculty of Engineering, Osaka University, (1981), pp. 22–29.
C.A. Mead, *Operation of Tunnel–Emission Devices*, Journal of Applied Physics, vol. 32, (1961) pp. 646–652.
W.P. Dyke, et al., *Field Emission*, Advances in Electronics and Electron Physics, vol. VIII, (1956) pp. 89–185.

* cited by examiner

*Primary Examiner*—Ashok Patel
(74) *Attorney, Agent, or Firm*—Fitzpatrick, Cella, Harper & Scinto

(57) ABSTRACT

In an electron source having an electron emitting member, the electron emitting member is connected to a first or second conductive member by a third conductive member which is connected to the first or second conductive member through an aperture forming in an insulating member, and such aperture has such a shape as to become narrower from an end of the third conductive member toward the other end. Such configuration avoids that the third conductive member is damaged in the connecting portion with the first or second conductive member by the thermal stress therein.

4 Claims, 14 Drawing Sheets

ELECTRON SOURCE AND PRODUCING METHOD THEREFOR

BACKGROUND OF THE INVENTION

1. Field of the Invention

The present invention relates to an electron source provided with wirings and electron emitting portions, and a producing method therefor.

2. Related Background Art

The electron emitting device is conventionally known in two types, namely a hot electron source and a cold cathode electron source. Within the cold cathode electron source, there are known, for example, an electric field emission type (hereinafter represented as EF), a metal/insulating layer/metal type (hereinafter represented as MIM), a surface conduction electron emitting device etc.

The element of EF type is disclosed for example by W. P. Dyke & W. W. Dolan, "Field emission", Advance in Electron Physics, 8, 89 (1956).

The element of MIM type is disclosed for example by C. A. Mead, "Tunnel-emission amplifier", J. Appl. Phys., 32, 646 (1961).

The surface conduction electron emitting device is disclosed for example by M. I. Elinson, Radio Eng. Electron Phys., 10 (1965).

The surface conduction electron emitting device utilizes a phenomenon of electron emission by causing, in a thin film of a small area formed on a substrate, an electric current parallel to the plane of the film. Such surface conduction electron emitting device is reported in various types such as one utilizing a thin $SnO_2$ film reported by Elinson mentioned above and others, one utilizing a thin Au film (G. Dittmer: "Thin Solid Films", 9, 317 (1972)), one utilizing an thin $In_2O_3/SnO_2$ film (M. Hartwell and C. G. Fonstad: "IEEE Trans. ED. Conf.", 519 (1975)) and one utilizing a thin carbon film (H. Araki et al., Shinkuu, 26, Vol. 1, p.22 (1983)).

As a representative device configuration of such surface conduction electron emitting devices, FIG. 14 shows the configuration of the device reported in the aforementioned reference of M. Hartwell. In FIG. 14, there are shown an insulating substrate 901, and a thin film 902 for forming an electron emitting portion, composed for example of an H-shaped metal oxide formed by sputtering and adapted to form an electron emitting portion 905 by a current-passing process, which is called forming as will be explained later.

In such surface conduction electron emitting device, an electron emitting portion 905 is generally formed by subjecting in advance the thin film 902 for forming the electron emitting portion, prior to the electron emission, to a current passing process which is called forming. More specifically, the forming process consists of applying a voltage across the ends of the thin film 902 for forming the electron emitting portion thereby locally destructing, deforming or denaturing such thin film to form the electron emitting portion 905 of an electrically high resistance state. The electron emitting portion 905 may be composed of fissures generated in a part of the thin film 902 for forming the electron emitting portion and may cause electron emission from the vicinity of such fissures.

The above-described cold cathode electron source, particularly the surface conduction electron emitting device, provides an advantage that a multitude of devices can be arranged over a large area because of its simple structure and easy manufacture. For this reason, there are being investigated various applications allowing to exploit such advantage. Examples of such applications include an electron source substrate (charged beam source) consisting of an array of plural electron emitting devices, and an image forming apparatus such as a display apparatus utilizing such electron source substrate.

A configuration of the electron source substrate consisting of an array of plural electron emitting devices has a simple matrix wiring including plural first conductor layers, plural second conductor layers crossing the plural first conductor layers, and plural electron emitting devices positioned at the respective crossing points of both conductor layers and connected to such both conductor layers.

FIG. 12 shows the configuration of a conventional electron source substrate in which the surface conduction electron emitting devices, constituting cold cathode electron emitting devices, are wired in a simple matrix (in which the second conductor layer is illustrated in a partially cut-off state), and FIGS. 13A to 13E show steps of the manufacturing process for the electron source substrate. In FIGS. 12 and 13A to 13E there is only shown the vicinity of a crossing portion of both conductor layers.

Referring to FIGS. 12 and 13A to 13E, there are shown a surface conduction electron emitting device 101, device electrodes 102, 103, a thin film 104 for forming an electron emitting portion, a first conductor layer 105, an interlayer insulation layer 106, a void pattern (contact hole) 107 provided in the interlayer insulation layer, and a second conductor layer 108.

In the connecting portion of the device electrode 102 and the second conductor layer 108, the second conductor layer 108 tends to become considerably thick since it is formed in a form sinking into the void pattern 107 provided in the interlayer insulation layer 106. Also the conductor layers tend to become thicker in realizing the matrix wiring of a low resistance.

Since the second conductor layer 108 is in general formed with a thick film material, there is generated a large thermal stress to eventually result in a phenomenon in which the device electrode 102, connected to the second conductor layer 108 and having different lengths at the left and right portions, is fissured in the longer portion by the thermal stress of the above-mentioned thick film, thereby significantly deteriorating the electrical connectivity in such portion.

SUMMARY OF THE INVENTION

In consideration of the foregoing, an object of the present invention is to improve the reliability in the electrical connection of an electron emitting member and wirings.

Another object of the present invention is to provide a producing method capable of improving the reliability of an electron source utilizing electron emitting devices, and of an image display apparatus utilizing such electron source.

The above-mentioned object can be attained, according to the present invention, by an electron source comprising first and second conductive members provided on a substrate and crossing mutually, an insulating member provided under the first or second conductive member and serving to insulate the mutually crossing first and second conductive members, and an electron emitting member electrically connected to the first and second conductive members, wherein the connection between the first or second conductive member and the electron emitting member is made by a third conductive member through an aperture provided in the insulating member, and the above-mentioned aperture includes an area, at an end area of the third conductive member realizing the connection between the first or second conductive member and the electron emitting member, where the width of the area becomes narrower from the above-mentioned end to the other end.

According to the present invention, there is also provided a method for producing an electron source of a simple matrix wiring structure provided, on an insulating substrate, with plural first conductive members, plural second conductive members crossing such plural first conductive members, and plural cold cathode electron emitting devices provided in the respective crossing positions of the first conductive members and the second conductive members and connected to such first and second conductive members, the method comprising:

a step of forming plural electrode pairs on an insulating substrate;

a step of forming plural first conductive members connected to either ones of the electrodes pairs;

a step of forming an insulating member covering a part of the first conductive members;

a step of forming, on the insulating member, plural second conductive members so as to cross the plural first conductive members; and a step of forming electron emitting portions between the electrode pairs;

wherein, in the step forming the aforementioned insulating member, an aperture for realizing the electrical connection between the other of the electrode pair and the second conductive member is formed in such a shape as to cross the other of the electrode pair in a non-linear manner.

DETAILED DESCRIPTION OF THE PREFERRED EMBODIMENTS

Figure 1:
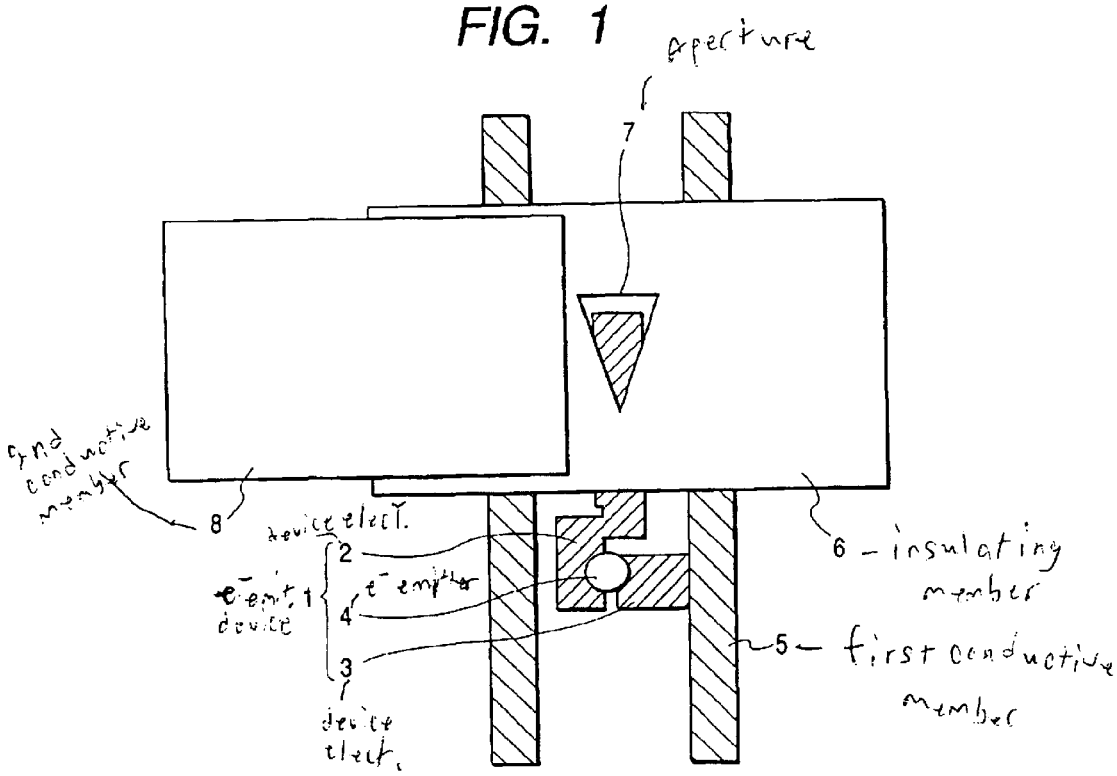
FIG. 1 is a schematic view showing a part of an electron source substrate of an embodiment of the present invention.

The present invention is to provide an electron source comprising first and second conductive members provided on a substrate and crossing mutually, an insulating member provided under the first or second conductive member and serving to insulate the mutually crossing first and second conductive members, and an electron emitting member electrically connected to the first and second conductive members, wherein the connection between the first or second conductive member and the electron emitting member is made by a third conductive member through an aperture provided in the insulating member, and the above-mentioned aperture includes an area, at an end area of the third conductive member realizing the connection between the first or second conductive member and the electron emitting member, where the width of the area becomes narrower from the above-mentioned end to the other end.

As more preferable embodiments, the electron source of the present invention further includes configurations that the aforementioned electron emitting member is positioned in an area on the substrate outside the area occupied by the first or second conductive member; or that the electron emitting member is provided on the substrate in plural units, which are wired in a matrix by a plurality of the first conductive members and a plurality of the second conductive members; or that an end of the third conductive member is present under the aforementioned aperture and the electrical connection between the first or second conductive member and the electron emitting member is realized by another conductive member filled in the aperture; or that the aforementioned another conductive member has a distribution in thickness in the aperture; or that the aforementioned distribution in thickness is such that the aforementioned third conductive member becomes thinner from an end thereof to the other end; or that the aforementioned another conductive member is the aforementioned first or second conductive member filled in the aperture.

The present invention also provides a method for producing an electron source of a simple matrix wiring structure provided, on an insulating substrate, with plural first conductive members, plural second conductive members crossing such plural first conductive members, and plural cold cathode electron emitting devices provided in the respective crossing positions of the first conductive members and the second conductive members and connected to such first and second conductive members, the method comprising:

a step of forming plural electrode pairs on an insulating substrate;

a step of forming plural first conductive members connected to either ones of the electrodes pairs;

a step of forming an insulating member covering a part of the first conductive members;

a step of forming, on the insulating member, plural second conductive members so as to cross the plural first conductive members; and a step of forming electron emitting portions between the electrode pairs;

wherein, in the step forming the aforementioned insulating member, an aperture for realizing the electrical connection between the other of the electrode pair and the second conductive member is formed in such a shape as to cross the other of the electrode pair in a non-linear manner.

In more preferred embodiments, the producing method of the present invention for the electron source is further featured in:

that the electrical connection between the other of the electrode pair and the second conductive member is realized by the aforementioned second conductive member filled in the aperture; or that the thickness of the aforementioned filled second conductive member is varied stepwise in the aperture of the insulating member and does not exceed 30 $\mu$m in the thickest portion; or that the aforementioned step of forming the electron emitting portions includes a step of forming a thin film for forming the electron emitting portion, and a step of applying a current passing process to such thin film for forming the electron emitting portion.

According to the present invention, there is also provided an image display apparatus comprising an electron source and a fluorescent member provided in a position opposed thereto and adapted to emit visible light by electron irradiation, wherein the electron source is the aforementioned electron source.

According to the present invention, there is also provided a method for producing an image display apparatus provided with an electron source and a fluorescent member provided in a position opposed thereto and adapted to emit visible light by electron irradiation, wherein the electron source is produced by the aforementioned method.

According to the electron source of the present invention or the producing method therefor, it is rendered possible to relax the stress applied to the member realizing the electrical connection between the first or second conductive member and the electron emitting member in the aforementioned aperture, thereby improving the reliability of the electrical connection of the electron emitting member and the wirings.

Also according to the electron source of the present invention or the producing method therefor, it is rendered possible, particularly in a matrix wiring, to stepwise vary the thickness of the conductive member in the aperture to be connected to the other (generally formed longer) of the aforementioned electrode pair, and to also stepwise vary the stress applied to the electrode connected thereto. It is thus possible to prevent fissure in the electrode connected thereto by the stress in the conductive member in the aperture, thereby significantly increasing the reliability of the electrical connection in such portion in comparison with the conventional configuration.

Also by so forming the aforementioned second conductive member as not to completely cover the aperture provided in the insulating member, there can be avoided current passing failure resulting from the floating phenomenon between the conductive member (for example second conductive member) filled in the aperture and the conductive member (for example the other of the electrode pair) positioned under the aperture.

In the following, the present invention will be clarified in more details with reference to the accompanying drawings.

FIG. 1 shows the configuration of an electron source substrate consisting of simple matrix wiring of surface conduction electron emitting devices, which are cold cathode electron emitting devices, to be employed in the image display apparatus embodying the present invention (wherein the second conductive member is illustrated in a partially cut-off state). FIG. 1 only shows the vicinity of a crossing portion of the both conductive members. Also FIGS. 2A to 2E show steps of the producing method for the electron source substrate shown in FIG. 1.

In these drawings, there are shown an electron emitting device 1, device electrodes (electrode pair) 2, 3, a thin film 4 for forming an electron emitting portion, a first conductive member 5, an insulating member 6, an aperture 7 provided in the insulating member, and a second conductive member 8.

In the following there will be explained in detail the method for producing the electron source substrate of the present embodiment, with reference to FIGS. 2A to 2E.

Figure 2A:
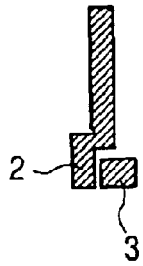
FIGS. 2A, 2B, 2C, 2D and 2E are views showing steps of a method for producing the electron source substrate in an embodiment of the present invention.

At first, on a substrate (not shown), device electrodes 2, 3 are formed (FIG. 2A). The device electrodes 2, 3 are provided for realizing satisfactory ohmic contact of the electron emission part forming thin film 4 with the first conductive member 5 and with the second conductive member 8. Since the electron emission portion forming thin film 4 is usually much thinner than the conductive members 5 and 8 for forming the wiring, the device electrodes 2, 3 are provided in order to avoid issues relating to "wetting property" or "film thickness retaining property".

The device electrodes 2, 3 may be formed by a vacuum film forming method such as vacuum evaporation, sputtering or plasma CVD, a thick film printing method such as printing and sintering thick film paste consisting of an Ag component and a glass component mixed in a solvent, or an offset printing method employing Pt paste. In case the conductive members 5 and 8 for forming the wirings are constituted by thin films formed for example by sputtering, the device electrodes 2, 3 need not necessarily be provided but can be formed simultaneously with the first conductive member 5 for wiring.

Figure 2B:
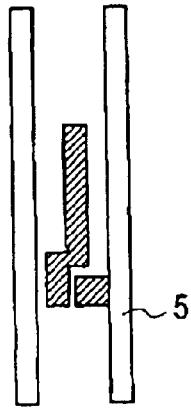

Then there is formed a first conductive member 5 to be connected with either of the device electrode pair (device electrode 3 in the present example) (FIG. 2B). The first conductive member 5 may be formed by various methods as in the case of formation of the device electrodes 2, 3, but, in case of the first conductive member 5, in contrast to the device electrodes 2, 3, a larger thickness is advantageous in order to reduce the electrical resistance. Consequently the thick film printing method can be advantageously adopted.

Recently there is developed a film forming technology utilizing photopaste by introducing photolithography into the thick film paste printing, and such film formation with the photopaste is naturally applicable. Such photopaste method is advantageous in case the width of the wiring (first conductive member 5) is narrow or in case a high positional precision is required in a large-sized substrate.

Naturally a thin film wiring is applicable, but there is required a long time in film formation in order to increase the film thickness for reducing the wiring resistance, and in practice it is not possible to increase the film thickness because of the internal stress of the film.

Figure 2C:
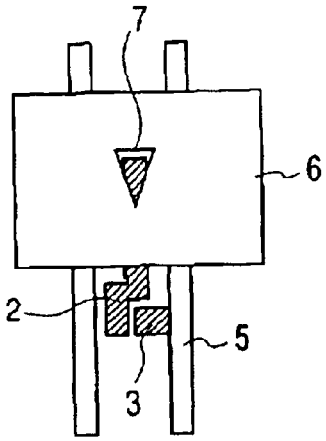

Then an insulating member 6 is formed (FIG. 2C). The insulating member 6 is so formed as to cover a part of the first conductive member 5, more specifically the crossing portion of the first conductive member 5 with the second conductive member 8.

The largest feature of the present invention lies in a fact that, in order to secure the connection between the other (device electrode 2 in the present example) of the device electrode pair and the second conductive member 8, the aperture 7 provided in the insulating member 6 is so formed as to cross the device electrode 2 in non-linear manner.

If the aperture 107 is formed with a rectangular pattern and positioned parallel to the form of the device electrode 102 as in the conventional method shown in FIGS. 12 and 13A to 13E, the aperture 107 crosses the device electrode 102 in linear manner.

The pattern crossing the device electrode 2 in non-linear manner can be, in addition to the triangular shape shown in FIG. 1, for example a rhombic shape, a circular shape or an oval shape.

An important factor in the pattern crossing the device electrode 2 in non-linear manner, for example in the triangular aperture 7, lies in a fact that the thickness of the second conductive member 8 spontaneously increases from the apex of such triangular shape toward the bottom side thereof. Thus, such configuration allows to form the second conductive member 8 without fissure of the device electrode 2 which is generally formed long. However, it is not enough to form the aperture 7 simply in a triangular shape. If the triangular aperture is formed in an upward pointed position (Δ) instead of the downward pointed position (▽) shown in FIG. 1, the device electrode 2 is crossed in a linear state, whereby the device electrode 2 may be fissured by the thermal stress in the second conductive member 8.

The insulating member 6 may be composed of any material capable of maintaining insulation, for example thick film paste not containing a metal component. Also there may be naturally used photopaste not containing metal component.

Figure 2D:
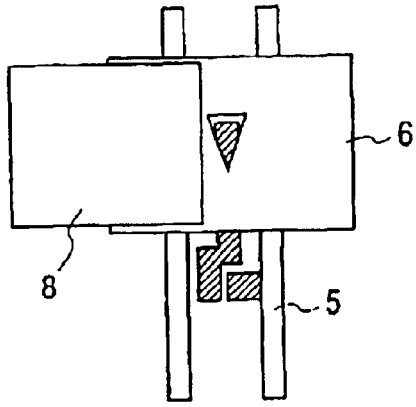

Then a second conductive member 8 is formed (FIG. 2D). For its formation, there can be employed a method similar to that of the first conductive member 5.

Figure 2E:
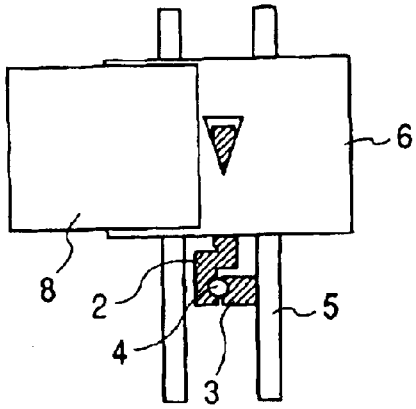

Then a thin film 4 for forming the electron emitting portion is formed, whereby a device 1 for the cold cathode electron beam source is completed (FIG. 2E). For forming the electron emission portion forming thin film 4 and the electron emitting portion, there can be utilized the conventional method.

FIGS. 1 and 2A to 2E only illustrate a device, but such device is simultaneously formed in plural units to obtain the configuration of an electron source substrate of simple matrix structure.

The representative configuration of a surface conduction electron emitting device, the producing method therefor and the characteristics thereof are disclosed for example in the Japanese Patent Application Laid-Open No. 2-56822.

In the following, there will be briefly explained the basic configuration of the surface conduction electron emitting device of the present embodiment, the producing method therefor and the characteristics thereof.

Figure 3A:
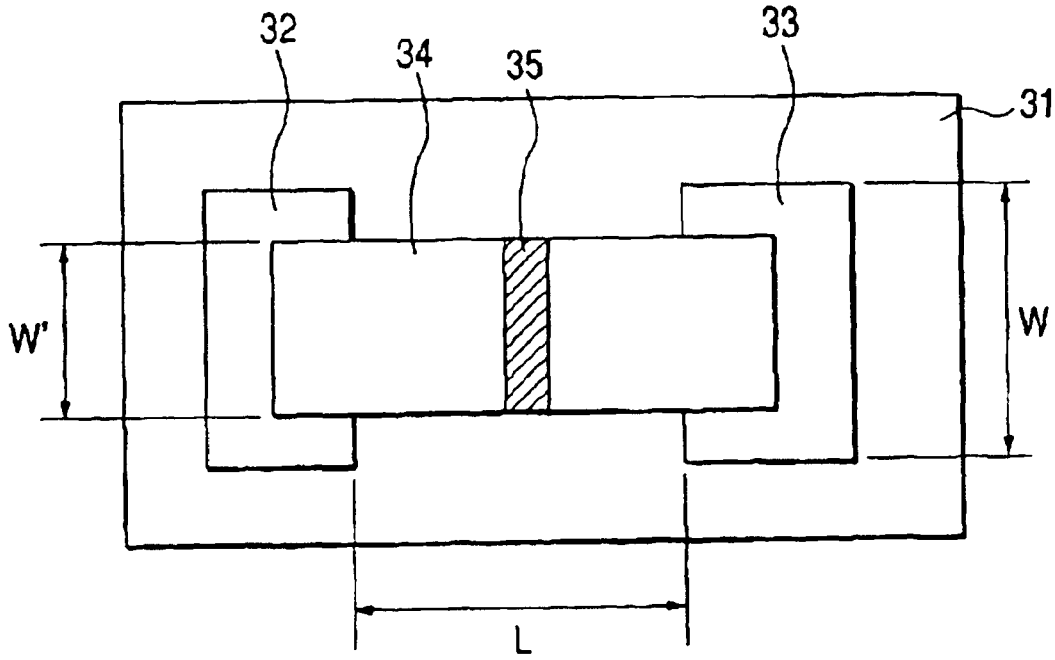
FIGS. 3A and 3B are views showing a typical configuration of a surface conduction electron emitting device.
Figure 3B:
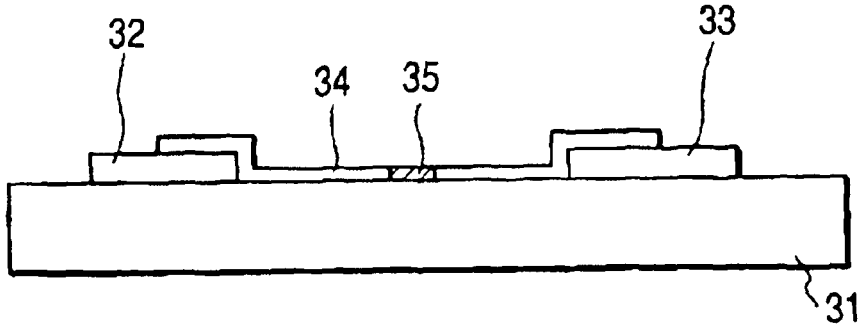

FIGS. 3A and 3B are views showing the configuration of a typical electron emitting device of the present invention, wherein shown are an insulating substrate 31, device electrodes 32, 33, a thin film 34 for forming an electron emitting portion, and an electron emitting portion 35.

In the present embodiment, within the electron emission portion forming thin film 34 including the electron emitting portion 35, the electron emitting portion 35 is composed of electroconductive particles of a particle size of several nanometers, while a portion excluding the electron emitting portion 35 within the thin film 34 is composed of a fine particulate film. The fine particulate film used herein means a film consisting of an assembly of plural fine particles, having a microstructure in which the fine particles may be not only in an individually dispersed state but also in mutually impinging or superposed (also in island shape) state.

Examples of the atoms or molecules constituting the electron emission portion forming thin film 34 including the electron emitting portion include metals such as Pd, Ru, Ag, Au, Ti, In, Cu, Cr, Fe, Zn, Sn, Ta, W or Pb, oxides such as PdO, $SnO_2$, $In_2O_3$, PbO or $Sb_2O_3$, borides such as $HfB_2$, $ZrB_2$, $LaB_6$, $CeB_6$, $YB_4$ or $GdB_4$, carbides such as TiC, ZrC, HfC, TaC, SiC or WC, nitrides such as TiN, ZrN or HfN, semiconductors such as Si or Ge, carbon, AgMg, NiCu and PbSn.

Also the electron emission portion forming thin film 34 can be formed, for example, by vacuum evaporation, sputtering, chemical gaseous growth, dispersion coating, dip coating or spin coating.

Figure 4A:
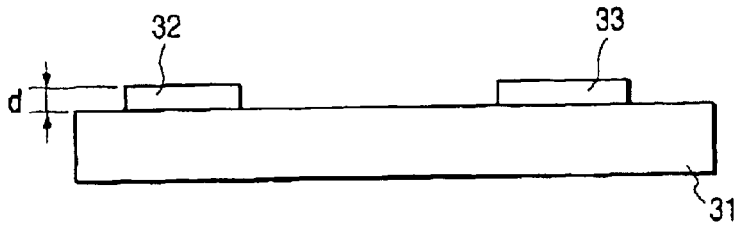
FIGS. 4A, 4B and 4C are views showing steps of a method for producing the surface conduction electron emitting device.
Figure 4B:
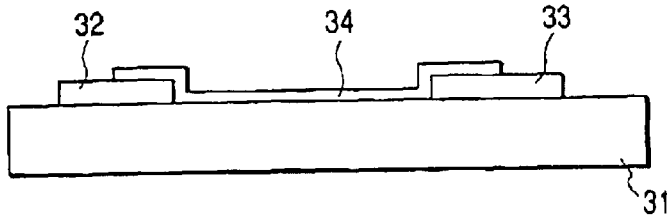
Figure 4C:
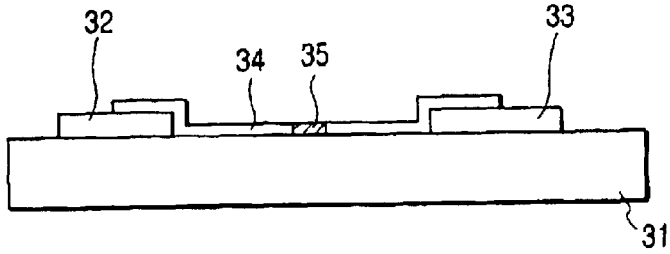

The surface conduction electron emitting device as shown in FIGS. 3A and 3B can be formed in various methods, and an example thereof is shown in FIGS. 4A to 4C.

In the following there will be explained the device producing method. In the following there will be explained the method for producing a single device, but such method is applicable also the preparation of the electron source substrate in the aforementioned embodiment of the present invention.

(1) At first an insulating substrate 31 is sufficiently rinsed with detergent, purified water and organic solvent, and, on such insulating substrate 31, there are formed device electrodes 32, 33 by vacuum evaporation technology and photolithography technology (FIG. 4A). The device electrodes 32, 33 may be composed of any electroconductive material, for example nickel metal. The device electrodes 32, 33 have a dimension, for example, of a device electrode distance L of 10 $\mu$m, a device electrode length L or 300 $\mu$m and a film thickness d of 100 nm. The device electrodes 32, 33 may also be formed by thick film printing. The material to be employed in case of printing method can be, for example, organometallic paste (MOD).

(2) Between the device electrodes 32, 33 formed on the insulating substrate 31, an organometallic thin film is formed by coating organometallic solution and letting it to stand. The organometallic solution is solution of an organic compound including, as a principal element, a metal such as Pd, Ru, Ag, Au, Ti, In, Cu, Cr, Fe, Zn, Sn, Ta, W or Pb. Thereafter, the organometallic thin film is sintered by heating and patterned by lift-off or etching to form an electron emission portion forming thin film 34 (FIG. 4B).

(3) Subsequently a voltage is applied between the device electrodes 32, 33 by a current-passing process, which is called forming, to form an electron emitting portion 35 of a modified structure in a part of the electron emission portion forming thin film 34 (FIG. 4C). Such current-passing process causes local destruction, deformation or denaturing of the electron emission portion forming thin film 34, and a portion with thus modified structure is called the electron emitting portion 33. As explained in the foregoing, the electron emitting portion 33 was observed to be composed of fine metal particles.

Figure 5A:
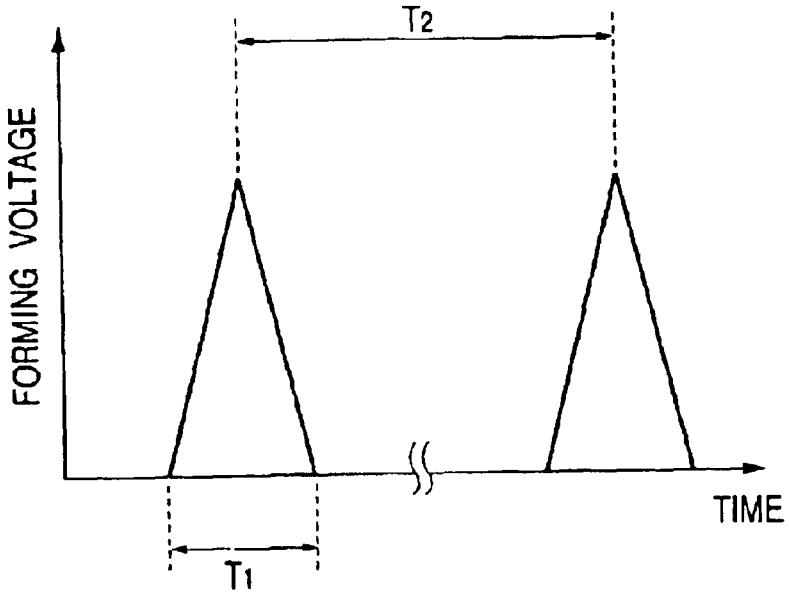
FIGS. 5A and 5B are charts showing typical wave forms employed in a forming process.
Figure 5B:
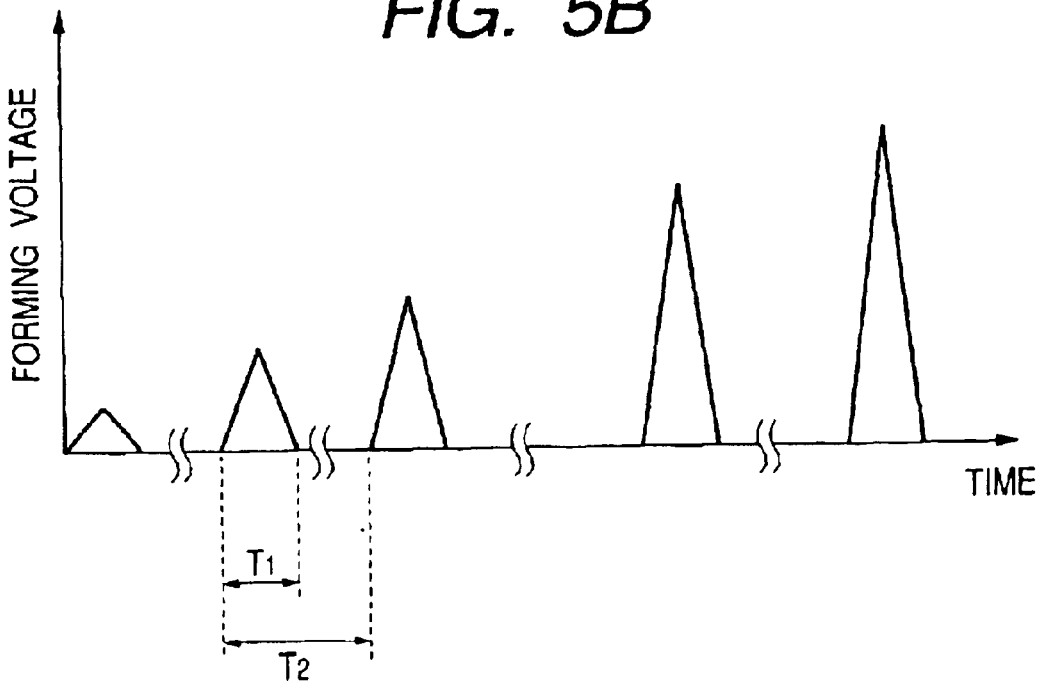

FIGS. 5A and 5B show the voltage wave forms in the course of the forming process, wherein T1 and T2 respectively indicate the pulse width and the pulse interval of the voltage wave form. The forming process was conducted for a suitable period of about several ten seconds under a vacuum condition, with T1 selected within a range of 1 microsecond to 10 milliseconds, T2 selected within a range of 10 microseconds to 100 milliseconds and the wave height of the triangular wave (peak voltage of the forming process) selected within a range of 4 to 10 V.

In the foregoing description, the electron emitting portion is formed by the forming process under the application of triangular pulses between the device electrodes, but the wave form applied between the device electrodes is not limited to a triangular wave and there may be employed any desired wave form such as a rectangular wave. Also the wave height, pulse width, pulse interval etc. are not limited to those explained in the foregoing, but there may be adopted any desired values as long as the electron emitting portion can be formed in satisfactory manner.

In the following there will be explained, with reference to FIGS. 6 and 7, the basic characteristics of the electron emitting device of the present embodiment, having the above-described device configuration and prepared by the above-described producing process.

Figure 6:
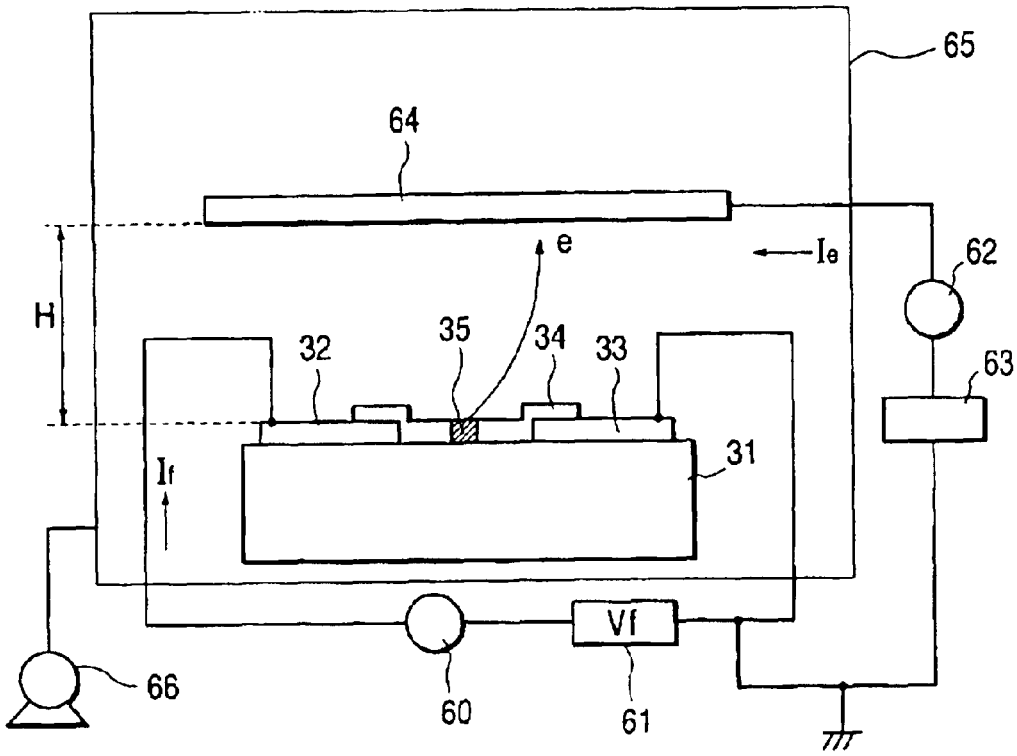
FIG. 6 is a view showing a characteristics evaluating apparatus for the surface conduction electron emitting device suitable for the present invention.

FIG. 6 is a schematic view showing the configuration of a measurement/evaluation apparatus for measuring the electron emitting characteristics of the device having the configuration shown in FIGS. 3A and 3B. In FIG. 6, there are shown an insulating substrate 31, device electrodes 32, 33, an electron emission portion forming thin film 34, and an electron emitting portion 35. There are also shown a power source 61 for applying a device voltage Vf to the device, an ammeter 60 for measuring a device current If flowing in the electron emission portion forming thin film 34, including the electron emitting portion 35, between the device electrodes 32, 33, an anode electrode 64 for collecting an emission current Ie released from the electron emitting portion 35 of the device, a high voltage source 63 for applying a voltage to the anode 64, and an ammeter 62 for measuring an emission current Ie released from the electron emitting portion 35 of the device.

For measuring the device current If and the emission current Ie of the electron emitting device, the power source 61 and the ammeter 60 are connected to the device electrodes 32, 33, and the anode electrode 64 connected to the power source 63 and the ammeter 62 is positioned above the electron emitting device. The electron emitting device and the anode electrode 64 are positioned in a vacuum apparatus 65, which is equipped with necessary devices such as a vacuum pump 66 and a vacuum meter and allows measurement/evaluation of the device under a desired vacuum condition. The measurement was conducted with a voltage at the anode electrode 64 within a range of 1 to 10 kV, and a distance H between the anode electrode 64 and the electron emitting device within a range of 3 to 8 mm.

Figure 7:
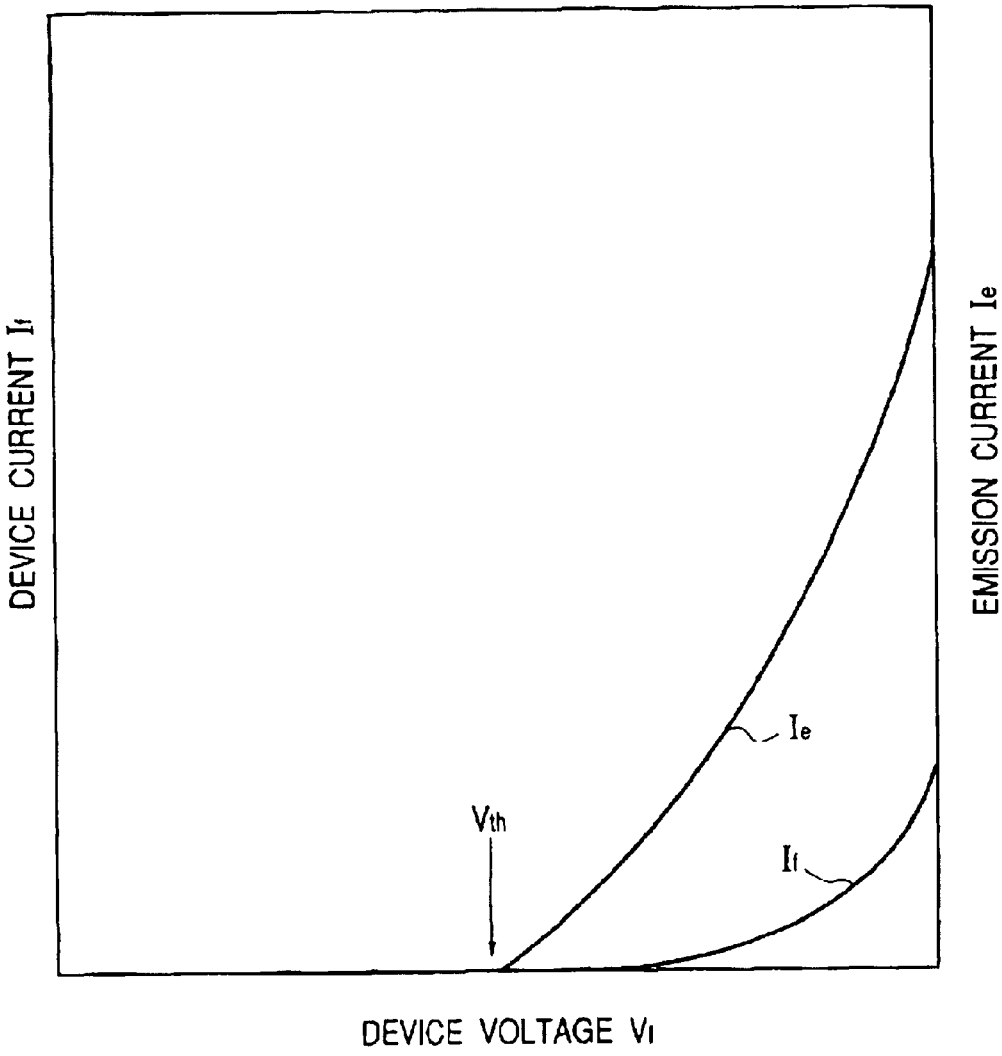
FIG. 7 is a chart showing typical characteristics of the surface conduction electron emitting device suitable for the present invention.

FIG. 7 shows a typical example of the relationship of the emission current Ie and the device current If as a function of the device voltage Vf, measured by the measurement/evaluation apparatus shown in FIG. 6. The chart in FIG. 7 is represented in an arbitrary scale, and the emission current Ie is about 1/1000 of the device current If. As will be apparent from FIG. 7, the present electron emitting device has three characteristics with respect to the emission current Ie.

Firstly, the present device shows a rapid increase of the emission current Ie under the application of a device voltage exceeding a certain value (threshold voltage Vth shown in FIG. 7), but the emission current Ie is scarcely detected under the threshold voltage. Thus, the present device is a non-linear device having a clear threshold voltage Vth for the emission current Ie.

Secondly, as the emission current Ie is dependent on the device voltage Vf, the emission current Ie can be controlled by the device voltage Vf.

Thirdly, the charge amount collected by the anode electrode 64 can be controlled by the duration of application of the device voltage Vf.

Owing to the above-described characteristics, the electron emitting device of the present invention is expected for various applications. In the foregoing there has been shown a case of monotonous increase (MI) characteristics of the device current If as a function of the device voltage Vf, but there may also be obtained voltage-controlled negative resistance (VCNR) characteristics between the device current If and the device voltage Vf. Also in this case, the electron emitting device has the three characteristics mentioned above. In case of a surface conduction electron emitting device formed by dispersing electroconductive fine particles in advance, such device can be obtained by modifying a part of the basic producing method for the basic device configuration in the foregoing embodiment.

Figure 8:
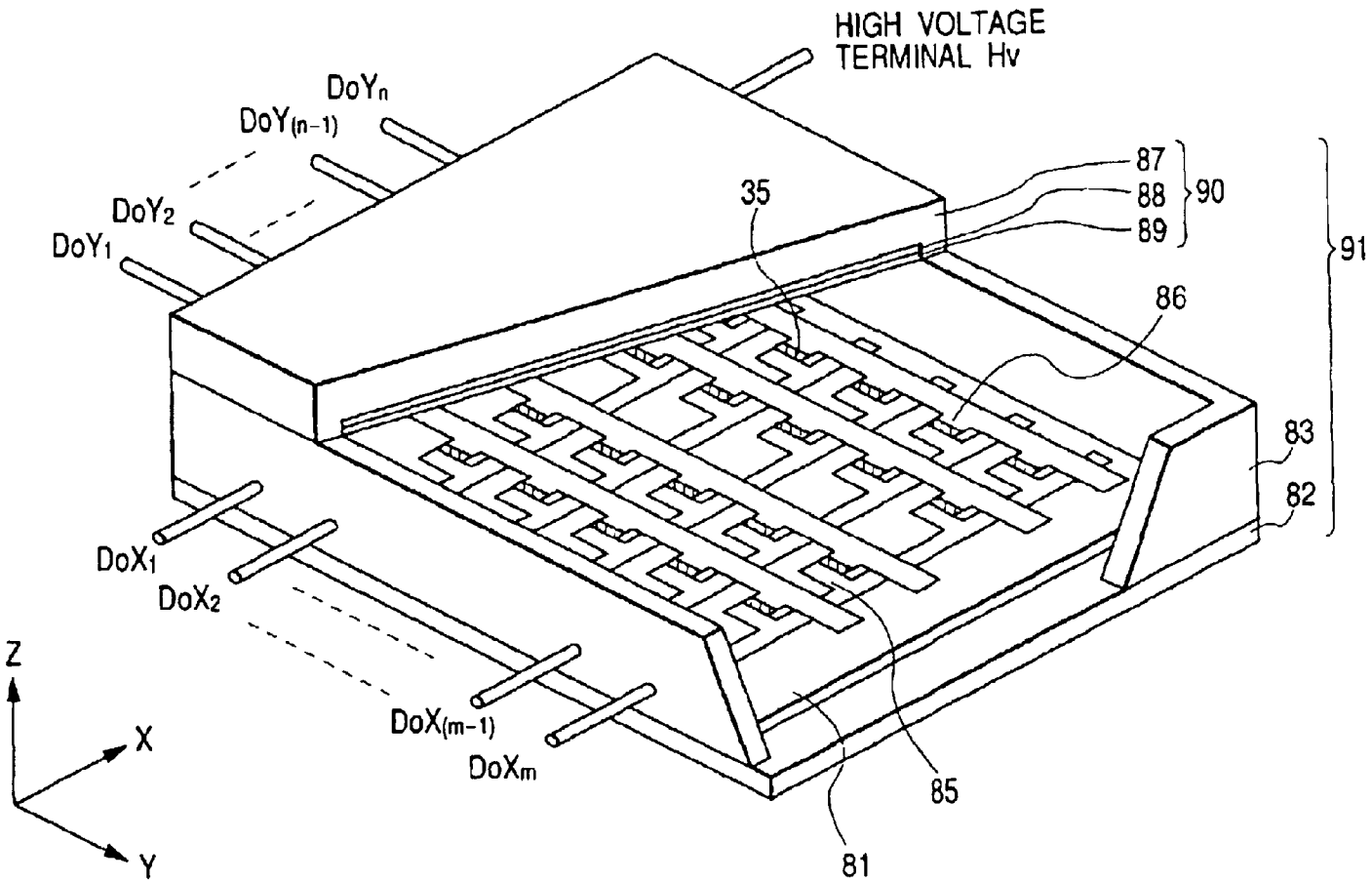
FIG. 8 is a partially cut-off perspective view of an image display apparatus constituting an embodiment of the present invention.

Also a representative configuration of a color image display apparatus, in which the electron source substrate of the present embodiment is applied, can be obtained at first by forming, on a substrate 81 shown in FIG. 8, plural units of an electron emitting device prepared by the method disclosed in the aforementioned Japanese Patent Application Laid-Open No. 2-56822. Then, after the substrate 81 is fixed on a rear plate 82, a face plate 90 (obtained by forming an fluorescent film 88 and a metal back 89 on the internal face of a glass substrate 87), is positioned in a position of 5 mm above the substrate 81 across a support frame 83. Then frit glass is coated on the adjoining portions of the face plate 90, support frame 83 and rear plate 82 and is sintered for 10 minutes or longer at 400 to 500° C. in atmospheric or nitrogen atmosphere to achieve hermetic sealing. Also the fixation of the substrate 81 to the rear plate 82 is achieved with frit glass. In FIG. 8, there are also shown electron emitting portions 35, X-direction wirings (first conductive members) 85 and Y-direction wirings (second conductive members) 86.

In the above-described configuration, an envelope 91 is constituted by the face plate 90, the support frame 83 and the rear plate 82, but, since the rear plate 82 is principally provided for reinforcing the strength of the substrate 81, the separate rear plate 82 can be dispensed with in case the substrate 81 itself has a sufficient strength, and the envelope 91 can be constituted by the face plate 90, the support frame 83 and the substrate 81 by directly sealing the support frame 83 to the substrate 81. The metal back 89 is usually provided on the internal face of the fluorescent film 88.

The metal back 89 is provided for mirror reflecting the internally directed light from the fluorescent member toward the face plate 90 thereby increasing the luminance, also for serving as an electrode for applying an electron beam accelerating voltage, and for protecting the fluorescent member from the damage resulting from collision of negative ions generated in the envelope.

The metal back 89 is prepared, after the preparation of the fluorescent film, by executing a smoothing process (ordinarily called filming) of the internal face of the fluorescent film and then vacuum evaporating Al. Also in order to increase the electroconductivity of the fluorescent film 88 in the face plate 90, there may be provided a transparent electrode (not shown) on the external face side of the fluorescent film 88.

In case of a color image display apparatus, in the aforementioned sealing operation, the fluorescent members of respective colors need to be sufficiently aligned with the electron emitting devices. After the interior of thus prepared glass contained is evaluated by the vacuum pump through an exhaust tube (not shown) to a sufficient vacuum level, a voltage is applied between the device electrodes through external terminals Dox1 to Doxm and Doy1 to Doyn to execute the aforementioned forming process, thereby forming the electron emitting portions 35 and completing the electron emitting devices. Finally, at a vacuum level of about $10^{-4}$ Pa, the exhaust tube is closed by fusing to seal the envelope. Then, after the sealing, there is executed a getter process for maintaining the vacuum level. In this operation, a getter provided in a predetermined position (not shown) of the image display apparatus is heated by resistance heating or radio frequency heating immediately before or after the sealing to form a getter evaporation film. The getter is usually composed principally of Ba or the like and is to maintain the vacuum level by the absorbing function of such evaporation film.

In the image display apparatus constructed by the above-described producing process, the electron emitting devices execute electron emission by the voltage application through the external terminals Dox1 to Doxm and Doy1 to Doyn.

More specifically, the external terminals Dox1 to Doxm corresponding to a scanning line are given in succession voltages of the image signal of each horizontal scanning period, while the external terminals Doy1 to Doyn are given voltages corresponding to the image signal intensity of the scanning line selected in such horizontal scanning period. Consequently, the electron emitting devices connected to the selected external terminals Doxi ($1 \leqq i \leqq m$) are given voltages corresponding to the intensity of the image signal, thereby emitting electrons corresponding to the intensity of the image signal. The external terminals Dox1 to Doxm and those Doy1 to Doyn may be used in mutually inverted manner.

Also a high voltage of several kilovolts or higher is applied through a high voltage terminal Hv to the metal back 89 or the transparent electrode to cause the electron beam to collide with the fluorescent film 88 under acceleration, thereby exciting the fluorescent member to cause light emission, thus forming an image. Naturally the above-described configuration is only the outline of the configuration required for forming an image display apparatus, and the materials etc. of the components are not limited to those described in the foregoing.

Figure 9A:
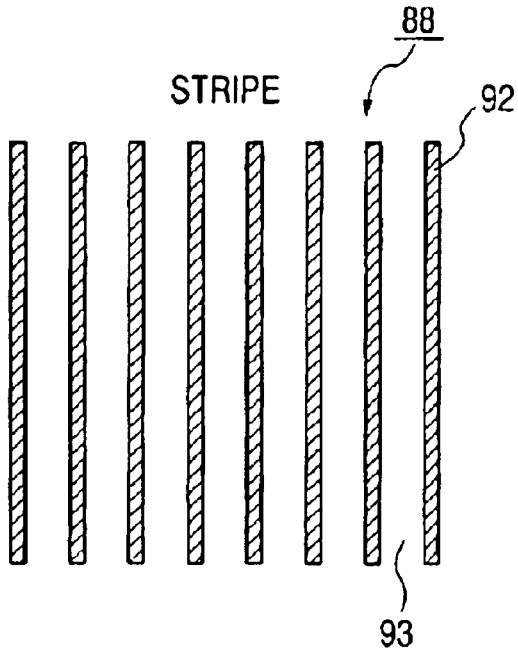
FIGS. 9A and 9B are views showing patterns of a fluorescent film.
Figure 9B:
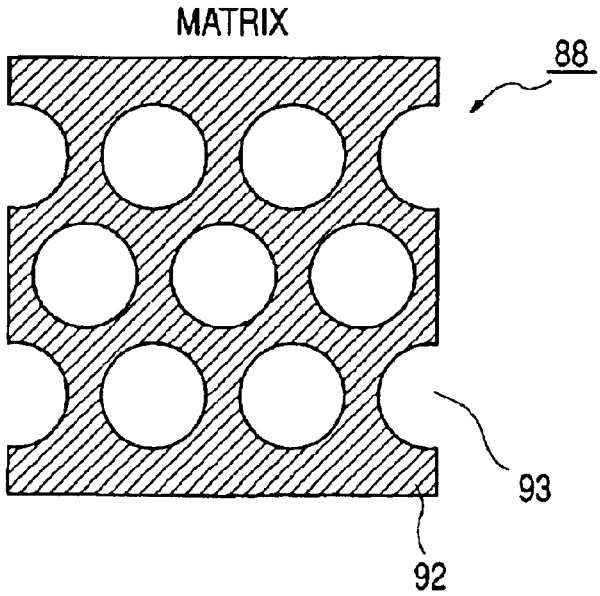

The fluorescent film 88 consists solely of a fluorescent member in case of monochromatic display, but, in case of color display, it is composed of fluorescent members 93 and a black member 92 which is called a black stripe or a black matrix depending on the arrangement of the fluorescent members as shown in FIGS. 9A and 9B. The black member 92 is provided in order to cover the boundary portions of the fluorescent members 93 of three primary colors required for color display thereby reducing the color mixing phenomenon, and to suppress the contrast loss resulting from the reflection of the external light by the fluorescent film 88. Such black member is usually composed principally of graphite, but there may be employed any material having electroconductivity and showing low transmission and reflection of light.

The fluorescent member 93 can be coated on the glass substrate 87 for example by a precipitation method or a printing method in case of monochromic display, or by a slurry method in case of color display. Also the printing method may naturally be employed for the color display.

EXAMPLES

In the following, the producing method of the present invention for the electron source substrate and in particular for the electron source substrate for use in the image display apparatus utilizing surface conduction electron emitting devices will be clarified further by examples.

Example 1

At first, Example 1 will be explained with reference to FIGS. 1 and 2A to 2E.

The present example is featured in that the aperture (contact hole) 7 of the interlayer insulation layer 6 is formed in a triangular (▽) shape and that the thickness of the second conductive member 8 is rendered variable stepwise.

At first the device electrodes 2, 3 were prepared. In the present example, a film was formed in vacuum by sputtering with a Pt target, with a film thickness of about 0.08 $\mu$m. After a film was formed by sputtering over the entire area of the substrate, it was patterned into a desired shape by photolithography. The device electrodes 2, 3 were patterned with different lengths on the right and left sides (FIG. 2A).

Then the first conductive member 5 was formed (FIG. 2B) with the printing method. Screen printing paste containing Ag as the conductive component was used in printing.

Then there was formed the insulating member 6 (FIG. 2C), with the contact hole 7 in triangular shape (▽) which is the feature of the present invention. There was employed photosensitive insulating paste containing PbO as the principal component and further mixed with a glass binder, a resinous component and a photosensitive component. The sintering was conducted at a temperature of 480° C. with a peak holding time of 10 minutes. In order to achieve sufficient insulation between the upper and lower layers, the insulating member 6 is formed by repeating the process of whole-area printing, pattern exposure, image development, drying and sintering. There can be adopted various pattern forming method, but, in the present example, there was adopted a process which consists of repeating twice (1) whole-area printing and (2) IR drying, then executing (3) pattern exposure, (4) image development and (5) sintering. The number of layers of the film can be increased or decreased in consideration of the insulation property.

Then the second conductive member 8 was formed (FIG. 2D) by thick film screen printing method. In this manner the matrix wirings are completed. Naturally the paste material and the printing method described in the foregoing are not restrictive.

After the completion of the wirings, the electron emission portion forming thin film 4 was formed (FIG. 2E). More specifically, organic palladium (CCP4230, Okuno Pharmaceutical Industries, Co.) was spin coated on the substrate having the aforementioned wirings and heated for 10 minutes at 300° C. to form a thin Pd film. The thin Pd film thus formed was composed of fine particles consisting of Pd as the principal element, and had a film thickness of 10 nm and a sheet resistance of $5\times10^4$ Ω/□. The sheet resistance is defined as the resistance of a conductor of which width is equal to length thereof, converted into a unit length. This Pd film was patterned by photolithography to form the electron emission portion forming thin film 4.

Then the forming process was executed. The forming can be conducted in the conventional method, and was executed in the following conditions (cf. FIG. 5A). Referring to FIG. 5A, the pulse width Ti and the pulse interval T2 of the voltage wave form were respectively selected as 1 millisecond and 10 milliseconds while the wave height of the triangular wave (peak voltage in forming) was selected as 14 V, and the forming process was executed for 60 seconds in a vacuum atmosphere of about $1.3\times10^{-4}$ Pa. The electron emitting portion prepared in this manner was in a state where fine particles principally composed of palladium element were dispersed and had an average particle size of 3 nm.

Then, after the forming process was completed for all the surface conduction electron emitting devices, the obtained electron source substrate was used to assemble the envelope 91 of the image display apparatus as shown in FIG. 8. Then the envelope was sealed at a vacuum level of about $1.3\times10^{-4}$ Pa by fusing the exhaust tube (not shown) with a gas burner.

Then, after the sealing, there was executed the getter process for maintaining the vacuum level. In this operation, a getter provided in a predetermined position (not shown) of the image display apparatus was heated by high frequency heating immediately before the sealing to form an evaporation film. The getter was composed principally of Ba or the like.

In thus completed image display apparatus of the present example, the electron emitting devices were given scanning signals and modulation signals from signal generation means (not shown), through the external terminals Dox1 to Doxm and Doy1 to Doyn to execute electron emission, and the high voltage of several kilovolts was applied to the metal back 89 through the high voltage terminal Hv to accelerate the electron beam, thereby causing collision, excitation and light emission of the fluorescent film and thus displaying an image.

Example 2

Figure 10:
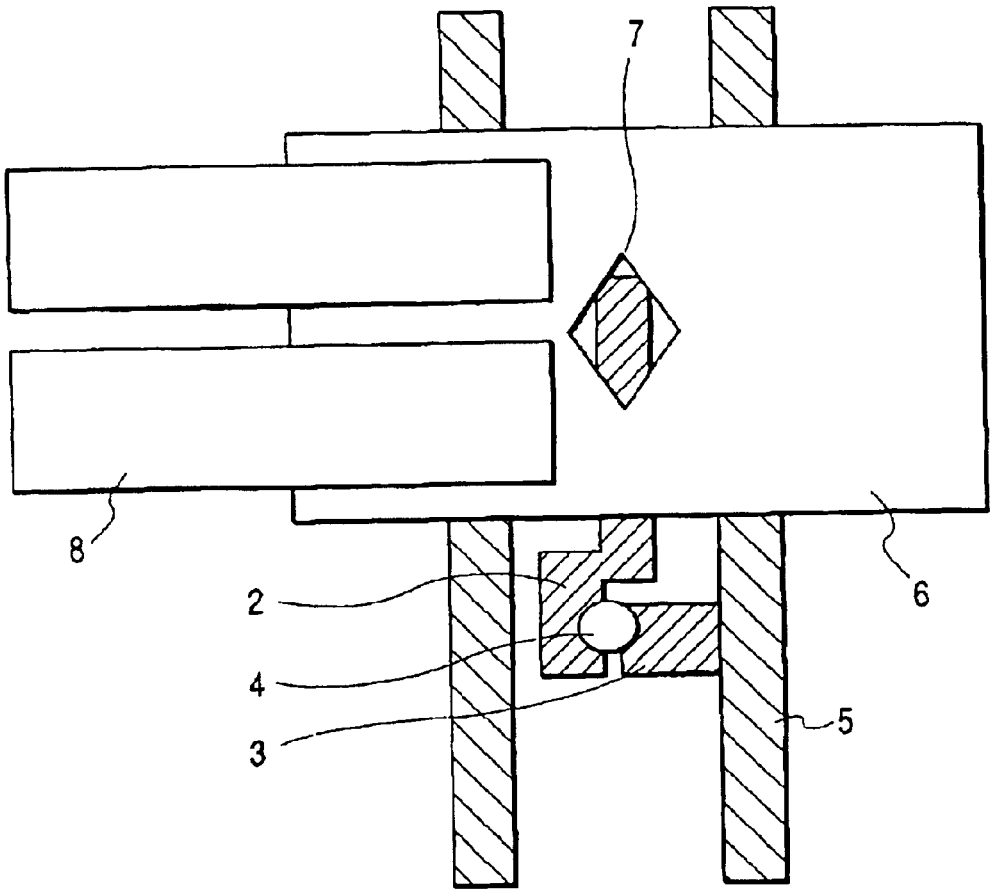
FIG. 10 is a schematic view of a part of an electron source substrate constituting an example 2 of the present invention.

Example 2 will be explained with reference to FIGS. 10 and 11A to 11E. FIG. 10 is a view showing the configuration of an electron source substrate (wherein a part of the second conductive member is omitted), consisting of simple matrix wirings of the surface conduction electron emitting device and employed in the image display apparatus of the present example, and illustrates only the vicinity of the crossing portion of both conductive members. Also FIGS. 11A to 11E show steps of the producing process for the electron source substrate.

The present example is featured in that the aperture (contact hole) 7 of the insulating member 6 is formed in a rhombic shape and that the thickness of the second conductive member 8 is rendered variable stepwise.

Figure 11A:
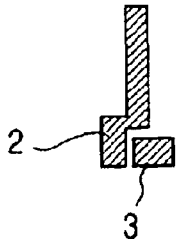
FIGS. 11A, 11B, 11C, 11D and 11E are views showing steps of a method for producing the electron source substrate of the example 2 of the present invention.
Figure 11B:
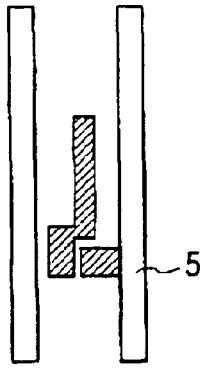
Figure 11C:
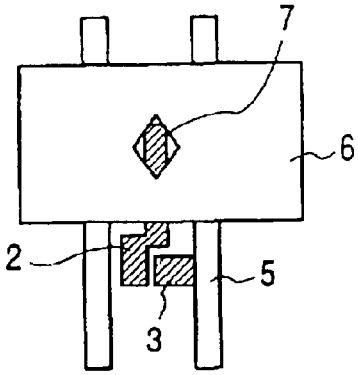
Figure 11D:
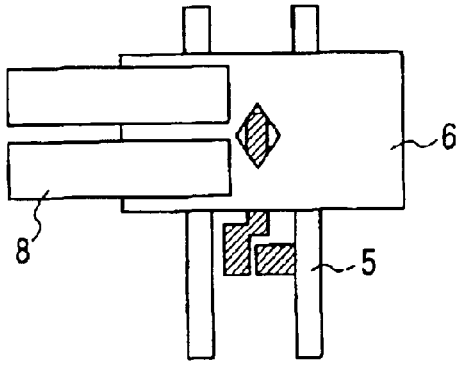
Figure 11E:
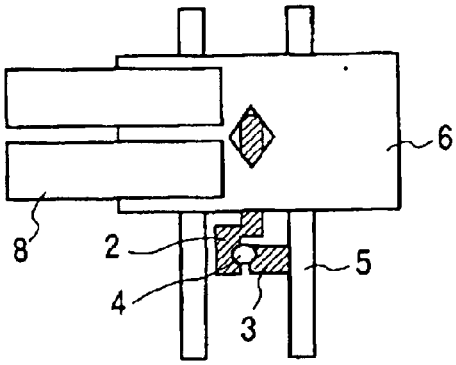
Figure 12:
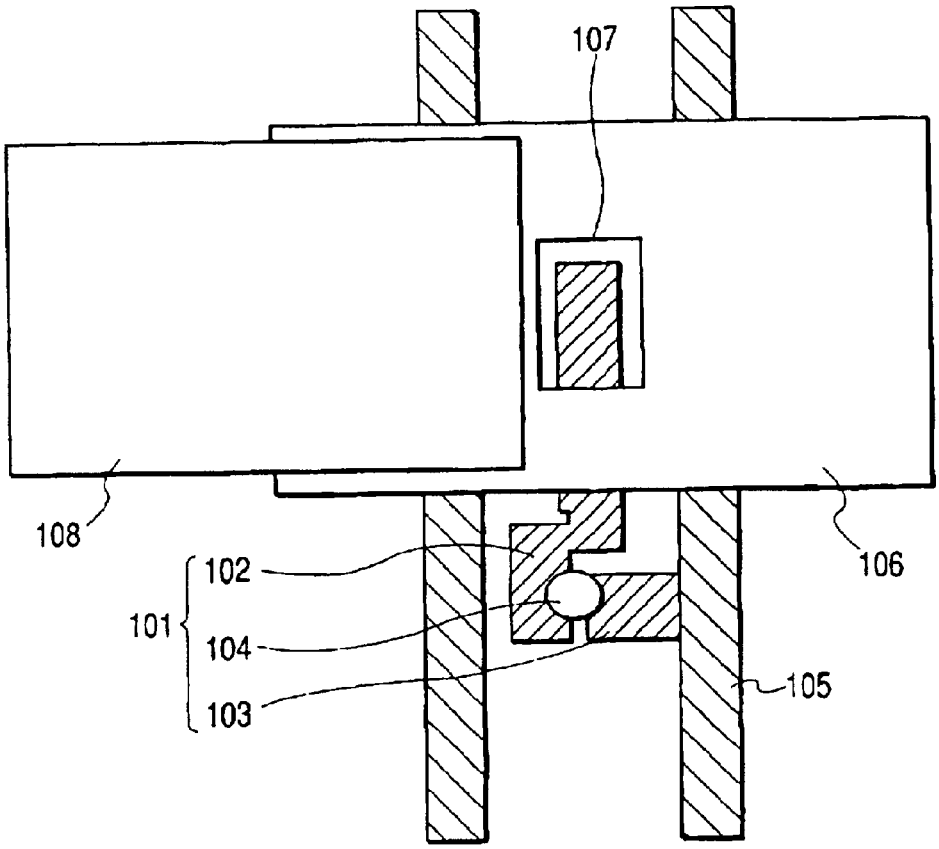
FIG. 12 is a schematic view showing a part of a conventional electron source substrate.
Figure 13A:
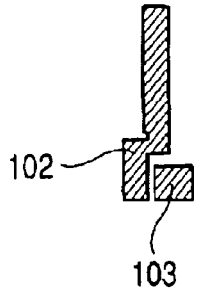
FIGS. 13A, 13B, 13C, 13D and 13E are views showing steps of a method for producing the conventional electron source substrate.
Figure 13B:
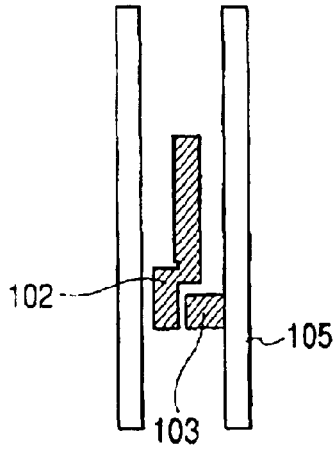
Figure 13C:
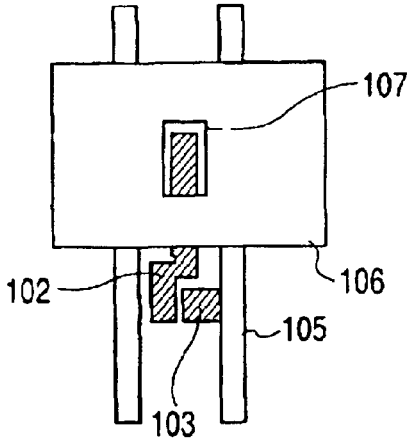
Figure 13D:
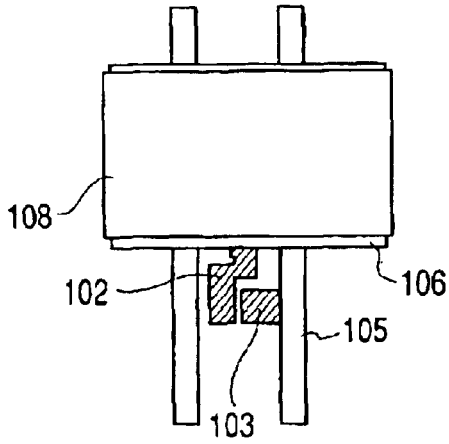
Figure 13E:
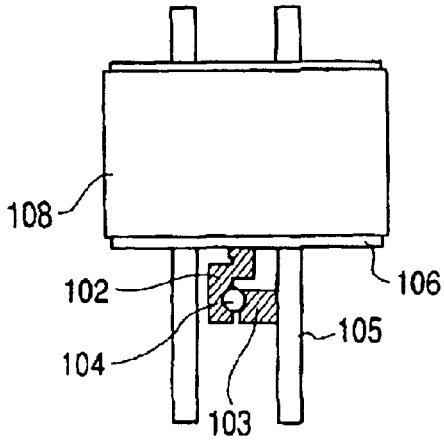
Figure 14:
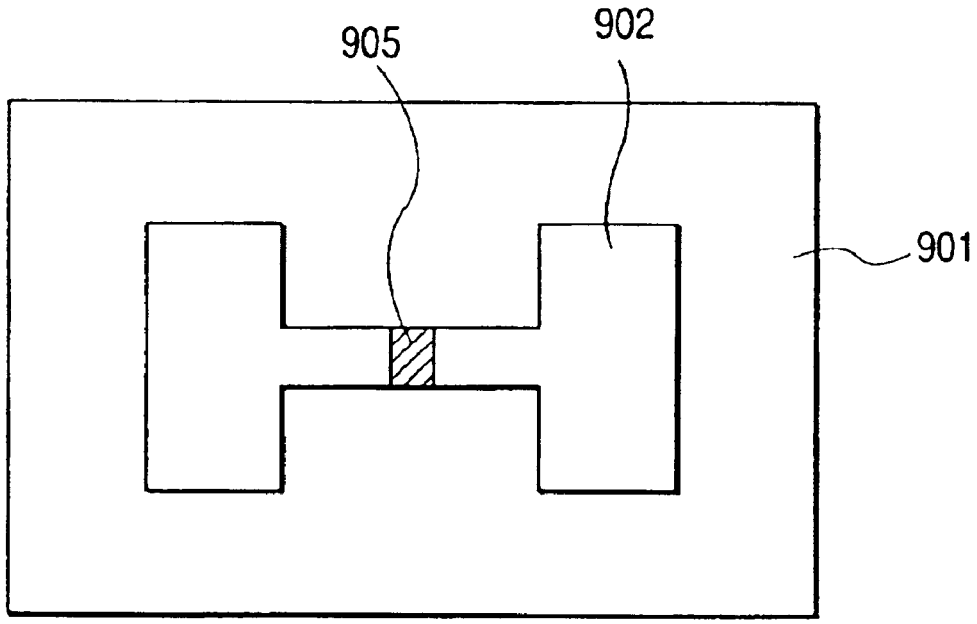
FIG. 14 PRIOR ART
FIG. 14 is a view showing a conventional surface conduction electron emitting device.

At first the device electrodes 2, 3 were prepared. In the present example, a film was formed in vacuum by sputtering with a Pt target, with a film thickness of about 0.08 $\mu$m. After a film was formed by sputtering over the entire area of the substrate, it was patterned into a desired shape by photolithography. The device electrodes 2, 3 were patterned with different lengths on the right and left sides (FIG. 11A).

Then the first conductive member 5 was formed (FIG. 11B) by a method of printing photosensitive paste over the entire surface and forming a pattern by photolithography. For the whole-area printing there was employed paste containing Ag as the conductive component.

Then there was formed the interlayer insulation layer 6 (FIG. 11C), with the contact hole 7 in rhombic shape which is the feature of the present invention. There was employed photosensitive insulating paste containing PbO as the principal component and further mixed with a glass binder, a resinous component and a photosensitive component. The sintering was conducted at a temperature of 480° C. with a peak holding time of 10 minutes. In the present example, there was adopted a process which consisted of repeating twice (1) whole-area printing and (2) IR drying, then executing (3) pattern exposure, (4) image development and (5) sintering.

Then the second conductive member 8 was formed (FIG. 1D) by thick film screen printing method. In this manner the matrix wirings are completed.

After the completion of the wirings, the electron emission portion forming thin film 4 was formed as in Example 1 (FIG. 1E).

After the forming process was executed as in Example 1, the obtained electron source substrate was used prepare an image display apparatus as shown in FIG. 8.

In thus completed image display apparatus of the present example, the electron emitting devices were given scanning signals and modulation signals from signal generation means (not shown), through the external terminals Dox1 to Doxm and Doy1 to Doyn to execute electron emission, and the high voltage of several kilovolts was applied to the metal back 89 through the high voltage terminal Hv to accelerate the electron beam, thereby causing collision, excitation and light emission of the fluorescent film and thus displaying an image.

According to the present invention explained in the foregoing, it is rendered possible to improve the reliability in the electrical connection between the electron emitting member and the wirings.

There is also provided a producing method capable of improving the reliability of the electron source utilizing electron emitting devices, and of the image display apparatus utilizing such electron source.

What is claimed is:

1. An electron source comprising a substrate, a first conductive member provided on a surface of said substrate, a second conductive member positioned on said substrate and crossing said first conductive member, an insulating member provided under said second conductive member and serving to insulate said first and second conductive members, and an electron-emitting device having a pair of electrodes, one electrode of the pair being connected to said second conductive member and another electrode of the pair being connected to said first conductive member, and an electron-emitting member disposed between the electrodes, wherein a connection between said second conductive member and the one of the electrodes is made through an aperture provided in said insulating member, and a shape of a cross section of said aperture obtained by cutting said insulating member along a surface approximately parallel with the surface of said substrate includes an area where a width of the area becomes narrower from one end to another end of said aperture, and a side at the one end of said aperture does not cross the one of the electrodes.

2. An electron source according to claim 1, wherein a thickness of said second conductive member in said aperture has a distribution.

3. An electron source according to claim 2, wherein the distribution of the thickness of said second conductive member in the aperture is stepwise.

4. An electron source according to claim 1, wherein a distribution of a thickness of said second conductive member in said aperture becomes thinner from one end of said aperture to the other end of said aperture.

* * * * *

UNITED STATES PATENT AND TRADEMARK OFFICE

CERTIFICATE OF CORRECTION

PATENT NO. : 6,853,117 B2
DATED : February 8, 2005
INVENTOR(S) : Hiroaki Toshima et al.

It is certified that error appears in the above-identified patent and that said Letters Patent is hereby corrected as shown below:

Title page,
Item [30], Foreign Application Priority Data
"Aug. 2, 2001 (JP) 2001/234364" should read
--Aug. 2, 2001 (JP) 2001-234364 --.

Drawings,
SHEET 7, FIG. 7, "VOLTAGE V1" should read -- VOLTAGE Vf --.

Column 1
Line 18, "device" should read -- device, --;
Line 20, "emission"," should read -- Emission", --; and
Line 35, "an" should read -- a --.

Column 3,
Line 62, "example" should read -- Example --; and
Line 65, "example" should read -- Example --.

Column 5,
Line 65, "details" should read -- detail --.

Column 9,
Line 5, "interval etc." should read -- interval, etc., --.

Column 10,
Line 62, "contained is evaluated" should read -- container is evaluated --.

Column 11,
Line 35, "materials etc." should read -- materials, etc., --.

Column 12,
Line 27, "method" should read -- methods --; and
Line 54, "width Ti" should read -- width T1 --.

UNITED STATES PATENT AND TRADEMARK OFFICE

CERTIFICATE OF CORRECTION

PATENT NO. : 6,853,117 B2
DATED : February 8, 2005
INVENTOR(S) : Hiroaki Toshima et al.

It is certified that error appears in the above-identified patent and that said Letters Patent is hereby corrected as shown below:

Column 14,
Line 2, "1D)" should read -- 11D) --; and
Line 6, "(FIG. 1E)." should read -- (FIG. 11E). --; and
Line 8, "used prepare" should read -- used to prepare --.

Signed and Sealed this

First Day of November, 2005

JON W. DUDAS
*Director of the United States Patent and Trademark Office*